US005752867A

United States Patent [19]

Koyanagi

[11] Patent Number: 5,752,867

[45] Date of Patent: May 19, 1998

[54] SMALL WATERCRAFT SEAT

[75] Inventor: Tomoyoshi Koyanagi, Iwata, Japan

[73] Assignee: Yamaha Hatsudoki Kabushiki Kaisha, Iwata, Japan

[21] Appl. No.: 721,242

[22] Filed: Sep. 26, 1996

[30] Foreign Application Priority Data

Sep. 26, 1995 [JP] Japan ..... 7-248065

[51] Int. Cl.[6] ..... B63H 21/32

[52] U.S. Cl. ..... 440/89; 114/363

[58] Field of Search ..... 114/363, 211, 114/270; 440/89

[56] References Cited

U.S. PATENT DOCUMENTS

| | | | |
|---|---|---|---|
| 4,664,054 | 5/1987 | Nishida | 114/270 |
| 4,982,682 | 1/1991 | Hattori | 114/270 |
| 4,997,399 | 3/1991 | Nakayasu et al. | 440/89 |
| 5,016,439 | 5/1991 | Nitta | 440/89 |
| 5,255,626 | 10/1993 | Hattori et al. | 114/363 |
| 5,390,621 | 2/1995 | Hattori et al. | 114/211 |
| 5,490,474 | 2/1996 | Ikeda | 114/343 |
| 5,511,505 | 4/1996 | Kobayashi et al. | 114/470 |

FOREIGN PATENT DOCUMENTS

| | | | |
|---|---|---|---|
| 125983 | 6/1987 | Japan | 114/470 |
| 125985 | 6/1987 | Japan | 114/363 |
| 162189 | 6/1990 | Japan | 114/270 |

*Primary Examiner*—Sherman Basinger
*Attorney, Agent, or Firm*—Knobbe, Martens, Olson, & Bear, LLP

[57] ABSTRACT

A small watercraft includes a hull with a deck portion. A longitudinally extending raised pedestal of the deck portion has an upper surface with a front portion and a rear portion. An engine compartment is formed at least in part beneath the front portion of the raised pedestal and contains an engine that drives a propulsion unit for powering the watercraft. An exhaust system communicates with the engine compartment and discharges exhaust gases from the watercraft. An access opening is provided in the front portion of the upper surface of the raised pedestal for allowing access to the engine compartment. A removable front seat member is supported by the front portion of the upper surface of the raised pedestal and covers the access opening. The front seat has front and rear ends. A latching assembly is provided adjacent to the rear end of the front seat member for detachably securing the front seat member to the front portion of the upper surface of the raised pedestal. A removable rear seat member is supported by the rear portion of the upper surface of the raised pedestal directly behind the front seat member. The rear seat member includes front and rear ends. The front end of the rear seat member covers the latching assembly associated with the front seat member so that the latching assembly is not accessible without removing the front seat member. An insert piece is provided near the periphery of the rear portion of the upper surface of the raised pedestal. The insert piece includes a ventilation mechanism that vents air from the engine compartment. A portion of the exhaust system extends at least partially through the access opening and below at least a portion of the front seat portion so as to provide a more ergonomic front seat member.

32 Claims, 8 Drawing Sheets

SMALL WATERCRAFT SEAT

BACKGROUND OF THE INVENTION

1. Field of the Invention

This invention relates generally to a small watercraft and more particularly to a seat for a small watercraft.

2. Description of Related Art

Personal watercraft popularity has dramatically increased in recent years. The popularity has grown at least in part because many personal watercraft accommodate several riders. Riders are supported within a rider's area defined above an engine compartment. The rider's area includes a front to rear extending straddle-type seat which the operator and at least one or two passengers may straddle.

Prior seats have suffered from several drawbacks. One of these drawbacks has been that the removal of the front seat has not required the prior removal of the rear seat. This becomes a problem during maintenance of the engine because the rear seat often becomes damaged or dirty. A mechanic, during maintenance of the engine, commonly removes only the front seat of the seat arrangement in order to access the engine through an access opening located below the front seat. Because the removal of the front seat does not require the prior removal of the rear seat, the rear seat usually remains on the watercraft during maintenance and becomes damaged or dirty.

Prior seats also lack ergonomic support, especially when the rider shifts his or her weight from side to side. The vertical height of the seating surface and upper surface of the raised pedestal (See A and B of FIG. 8) have been relatively fixed in the past because the seating surface is provided at a height that is appropriate for a majority of riders and the upper surface of the raised pedestal is provided at a height that allows the raised pedestal to contain the engine components. These constraints have forced the contour of prior seats to have a broad, flat upper surface with a small radius of curvature transition between the upper surface and the side surfaces (See B of FIG. 8) in order to provide enough cushioning for the rider. The small radius of curvature transition between the upper surface and the side surfaces of prior seats tends to be uncomfortable for many riders, especially when leaning to one side.

SUMMARY OF THE INVENTION

One feature of the present seat prevents a rear seat member from becoming damaged or dirty during maintenance of the engine by a mechanic. This feature is adapted to be embodied in a small watercraft that includes a hull with a deck portion having a longitudinally extending raised pedestal. The raised pedestal has an upper surface with a front portion and a rear portion. An engine compartment is formed at least in part beneath the front portion of the raised pedestal and contains an engine that drives a propulsion unit for powering the watercraft. An access opening is provided in the front portion of the upper surface of the raised pedestal for allowing access to the engine compartment. A removable front seat member is supported by the front portion of the upper surface of the raised pedestal for accessing the engine compartment. The front seat member has front and rear ends. A latching assembly is provided adjacent the rear end of the front seat member for detachably securing the front seat member to the front portion of the upper surface of the raised pedestal. A removable rear seat member is supported by the rear portion of the upper surface of the raised pedestal directly behind the front seat member. The rear seat member includes front and rear ends. The front end of the rear seat member covers the latching assembly associated with the front seat so that the latching assembly is not accessible without removing the front seat.

Another feature of the present seat eliminates the ergonomic and comfort problems caused by the small radius of curvature transition between the upper surface and side surfaces of prior seats. This feature is adapted to be embodied in a small watercraft that includes a hull having a deck portion. A longitudinally extending raised pedestal extends from the deck portion and includes an upper surface. An engine compartment is formed at least in part beneath the raised pedestal. An engine is contained within the engine compartment and drives a propulsion unit which powers the watercraft. An exhaust system communicates with the engine and discharges exhaust gases from the watercraft. An access opening is provided in the upper surface of the raised pedestal for allowing access to the engine compartment. A seating assembly that includes at least one removable seat member is supported by the upper surface of the raised pedestal. A portion of the exhaust system extends at least partially through the access opening and below at least a portion of said seat member so as to provide a more ergonomic seat member.

A further feature of the present seat assists in ventilating the engine compartment. This feature is adapted to be embodied in a small watercraft that includes a hull having a deck portion. A longitudinally extending raised pedestal extends from the deck portion and includes an upper surface. An engine compartment is formed at least in part beneath the raised pedestal. An engine is contained within the engine compartment and drives a propulsion unit that powers the watercraft. A seating assembly including at least one seat member is supported by the upper surface of the raised pedestal. An insert piece is provided near the periphery of the upper surface of a rear portion of the raised pedestal. The insert piece includes a venting mechanism for venting air from the engine compartment

BRIEF DESCRIPTION OF THE DRAWINGS

These and other features of the invention will now be described with reference to the drawings of the preferred embodiment of the small watercraft seat. The preferred embodiment of the invention is intended to illustrate and not to limit the invention. To assist the reader's understanding of the description of the preferred embodiment which follows, the following provides a brief description of each of the referenced drawings:

FIG. 1 shows a portion of the watercraft in phantom.

DETAILED DESCRIPTION OF THE PREFERRED EMBODIMENT

Figure 1:
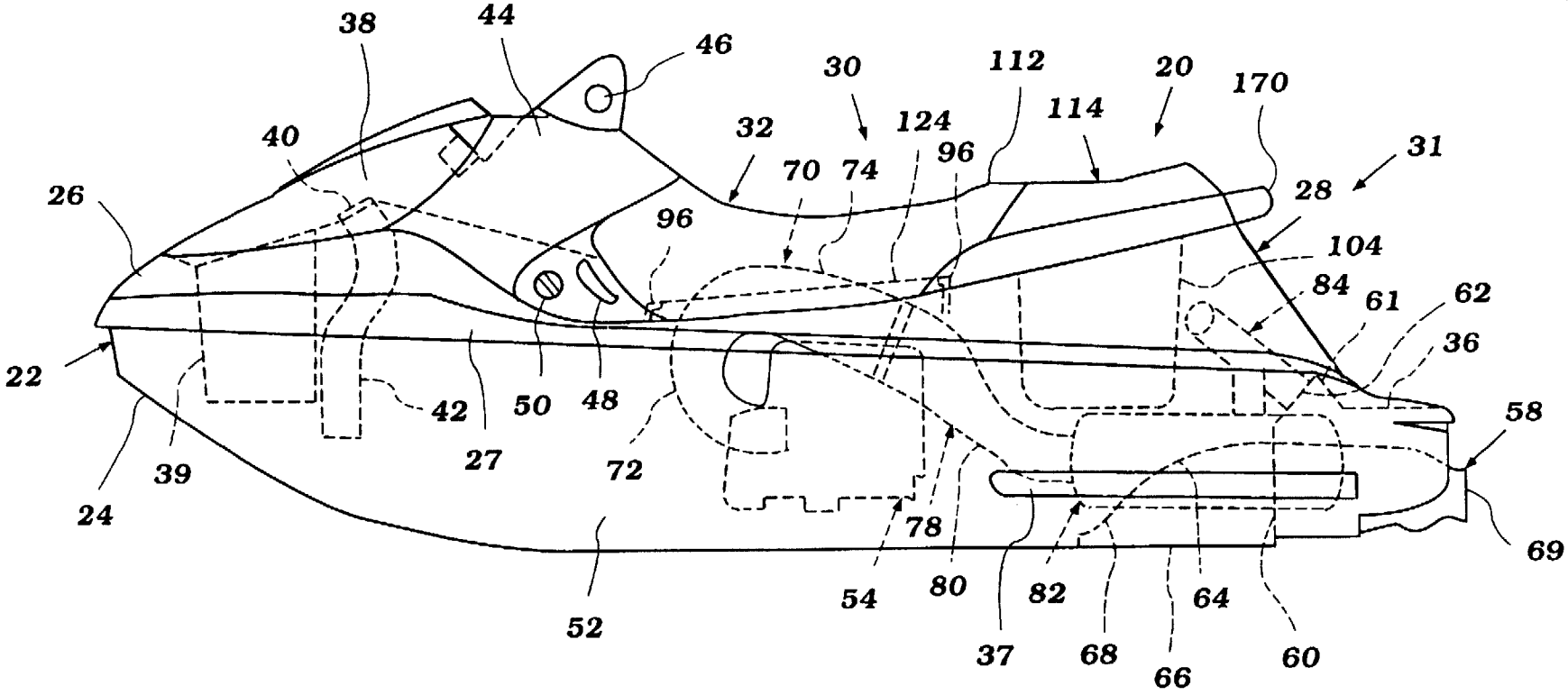
FIG. 1 is a side elevational view of a personal watercraft which includes a seat constructed in accordance with an embodiment of the invention.
Figure 2:
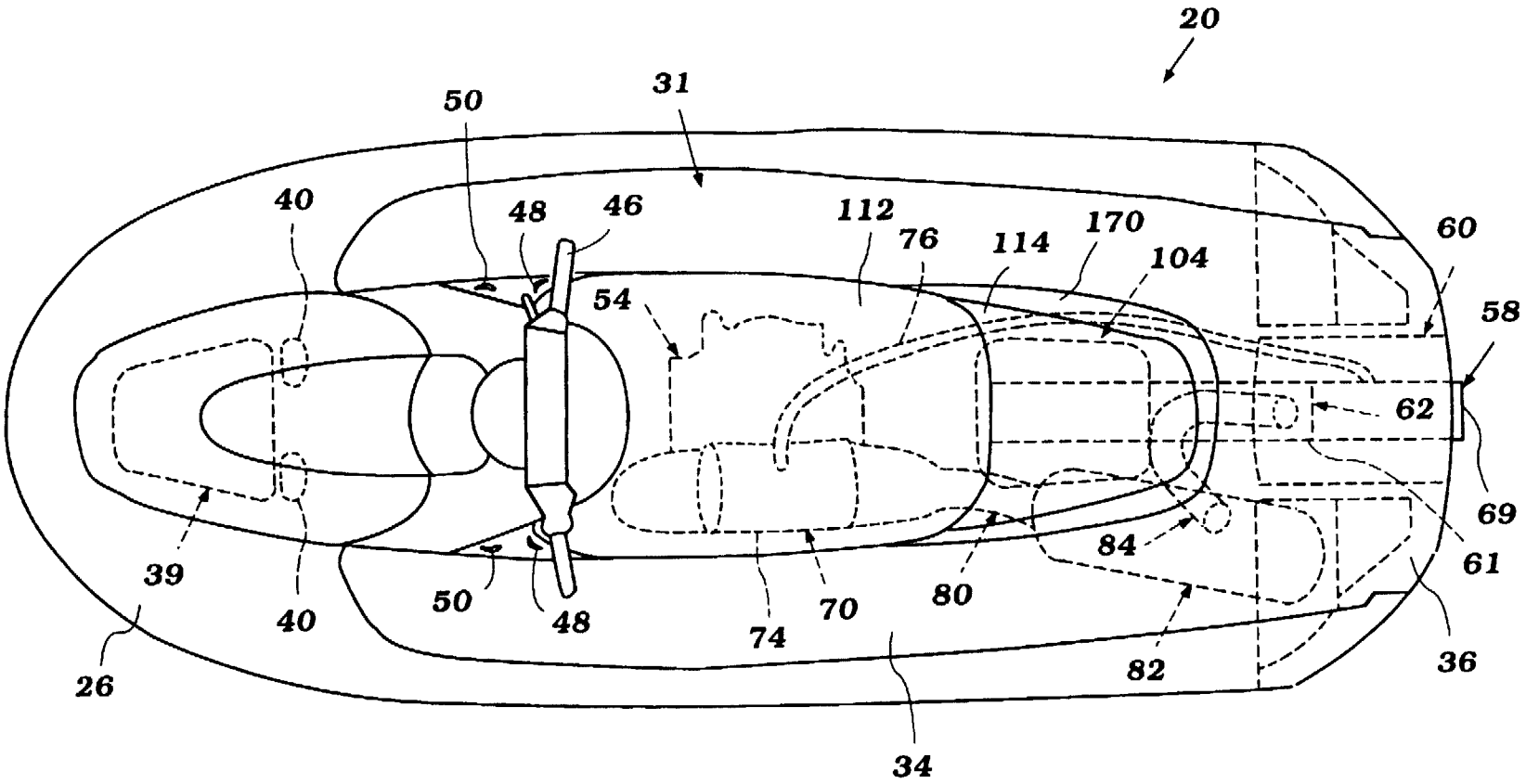
FIG. 2 is a top plan view of the watercraft of FIG. 1 and shows a portion of the watercraft in phantom.

With reference to the drawings, and initially to FIGS. 1 and 2, a small watercraft constructed in accordance with an embodiment of the invention is identified generally by the reference numeral 20. The watercraft 20 is depicted as being of the type known as a personal watercraft. Although the invention is described in conjunction with this type of watercraft, it will be readily apparent to those skilled in the art that certain facets of the invention may be employed with other types of watercrafts or other types of vehicles.

The watercraft 20 comprises a hull assembly, indicated generally by the reference numeral 22, which includes a lower hull portion 24 and an upper deck portion 26. A rear, lower portion of the lower hull 24 has a step-shaped design that reduces the drag on the rear portion of the hull so as to improve the performance of the watercraft. The portions 24, 26 are formed from a suitable material such as molded fiberglass-reinforced resin, or the like, and are connected to each other in any known manner in the art. Normally, the connection is provided at an outstanding flange or gunnel 27 that extends around the peripheral edge of the hull 24.

The rearward portion of the hull 22 defines a rider's area. A longitudinally elongated raised pedestal 28 extends from the upper deck 26 in this area and supports a seating assembly 30. The seating assembly 30 is designed to seat one or more riders in a straddle-type fashion. Together, the raised pedestal 28 and seating assembly 30 form a seat 31 that will be described in greater detail below.

With reference to FIG. 2, foot areas 32 are formed on the sides of the pedestal 28 between the gunnels 27 and the pedestal 28. Riders may place their feet in the foot areas 32 when straddling the seat 31. The outer sides of the foot areas 32 are bounded by raised gunnels 34. The raised gunnels 34 provide protection for the sides of the riders. A rear part of each of the foot areas 32 opens into a boarding platform 36 that is used by the riders to assist them in boarding the watercraft from the rear.

A pair of sponsons 37 are provided below the raised gunnels 34 along opposite sides of a rear portion of the lower hull 24. The sponsons 37 improve the turning performance of the watercraft.

The front of the deck 26 includes a hatch cover 38. Disposed beneath the hatch cover 38 is a storage container 39 for storing various items.

A pair of atmospheric air inlets 40 are provided in the front of the deck 26 above the hatch cover 38 and communicate with a ventilating duct 42 for supplying air to the engine compartment.

A raised control area 44 extends from the deck 26 behind the hatch cover 38 and includes a control mast 46 for steering the watercraft in a manner that will be described. Other watercraft controls, such as a throttle control, may be carried by the mast 46.

A second pair of air inlets are provided in opposite sides of the raised control area 44 for supplying air to the engine compartment. A fuel cock 50 is provided next to the air inlets 48 on the sides of the raised control area 44 for controlling fuel supplied to an engine to be described.

The lower hull portion 24 and upper deck portion 26 form an engine compartment 52 located at least in part below the raised pedestal 28. The engine compartment 52 terminates at its rear end in a bulkhead (not shown). Mounted within the engine compartment, forwardly of the bulkhead and primarily beneath a front portion of the seating assembly 30, is an internal combustion engine, indicated generally by the reference numeral 54. The engine 54 may be of any known type, but is desirably of a two-cylinder inline type, operating on a two-stroke crankcase compression principle. Those skilled in the art will readily appreciate that the invention can be employed with engines that run on other combustion principles, such as a four-stroke engine, have various cylinder numbers and have various cylinder orientations.

Figure 8:
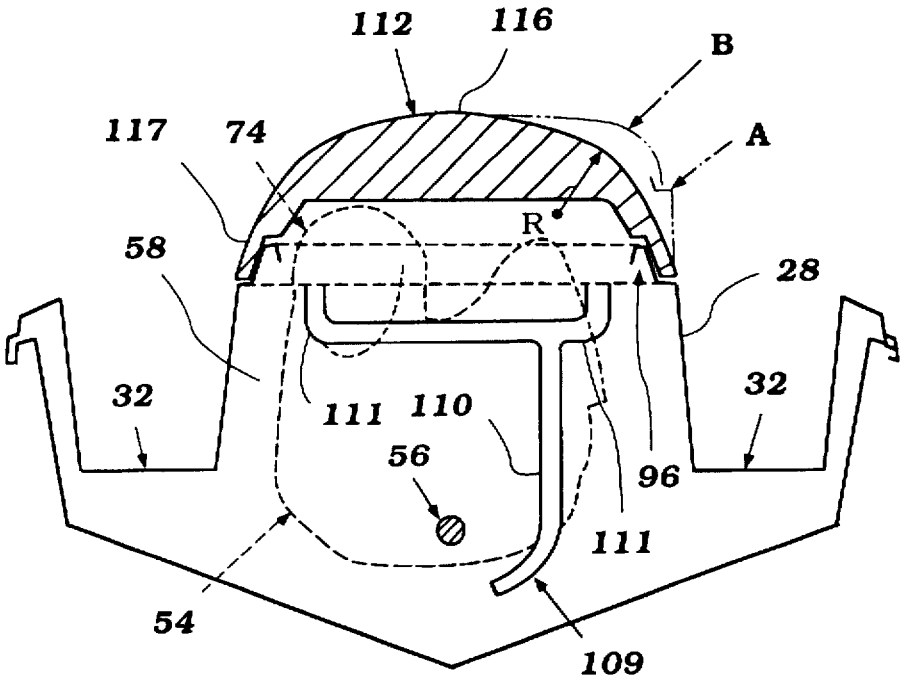
FIG. 8 is a transverse cross-sectional view of the personal watercraft of FIG. 1 and shows in phantom the position of the pedestal and the contour of the seat cushion in a prior seat.

Engine mounts (not shown) are used to mount the engine 54 to the lower hull portion 24. The engine 54 drives a rotating output shaft (not shown), such as a crankshaft, that extends rearwardly from the engine 54. A coupling (not shown) interconnects the engine output shaft with an impeller shaft 56 (FIG. 8). The impeller shaft extends within a jet propulsion unit 58.

The jet propulsion unit 58 is housed within a tunnel formed by a tunnel wall (not shown) of the lower hull portion 24. The tunnel includes a front portion (not shown) and slightly larger rear portion 60 located directly behind the front portion. A projecting portion 61 extends from the rear portion 60 and includes an upwardly and rearwardly angled face 62. The jet propulsion unit includes an outer housing assembly that has a water inlet duct-forming portion 64 that terminates in a downwardly facing water inlet opening 66. Water is supplied to this opening 66 in a manner that will be described. The housing includes a forwardly-extending tubular portion (not shown). The impeller shaft 56 passes through, and is journaled within, this tubular portion.

An impeller (not shown), affixed for rotation with the impeller shaft 56, draws water through the inlet opening 66 and through an inlet channel 68. The water is discharged through straightening vanes and a discharge nozzle portion (not shown). The water then passes through a steering nozzle 70. The steering nozzle 70 is supported for steering movement about a vertically extending steering axis (not shown) and is coupled to the steering mast 46 for steering of the watercraft in a well-known manner.

An exhaust system, indicated generally by the reference numeral 70, communicates with the engine 54 for removing exhaust gases from the watercraft. The exhaust system 70 includes an exhaust manifold (not shown) that receives the exhaust gases from the engine in a well-known manner and transfers them through a C-shaped pipe section 72 to an expansion chamber device 74, which is disposed at one side of the engine 54. The expansion chamber 74 is disposed beneath at least a portion of the front of the seating assembly 32 and extends at least partially through an access opening 98 of the raised pedestal 28 for a purpose to be described.

The C-shaped pipe section 72 and expansion chamber 74 include a water cooling jacket for maintaining this part of the exhaust system at a desired temperature. A conduit 76 communicates the jet propulsion unit 58 with the expansion chamber 74 for assisting the cooling jacket for this purpose.

The expansion chamber 74 communicates with an exhaust pipe 80, which in turn delivers exhaust gases to a water trap device 82. The water trap device 82, as is well known in the marine art, is designed so as to permit the exhaust gases and cooling water to exit the watercraft while inhibiting the backflow of water to the engine 54 through the exhaust system 70. An exhaust pipe 84 delivers exhaust gases to the aforementioned tunnel. The exhaust pipe 84 joins with the tunnel at the upwardly angled face 62 of the protruding protruding portion 69. In this manner, the exhaust pipe 84 discharges exhaust gases at a downward angle so that water is inhibited from entering the exhaust system 70 through the pipe 84. The exhaust gases are discharged downwardly, towards the water line, to assist in the silencing of the exhaust gases.

A fuel tank (not shown) supplies fuel to the engine 54 and is desirably positioned in the engine compartment 52 in front of the engine 54. The fuel tank, engine 54 and expansion chamber 74 are disposed substantially along the longitudinal centerline of the watercraft so as to maintain side-to-side balance of the watercraft.

Figure 3:
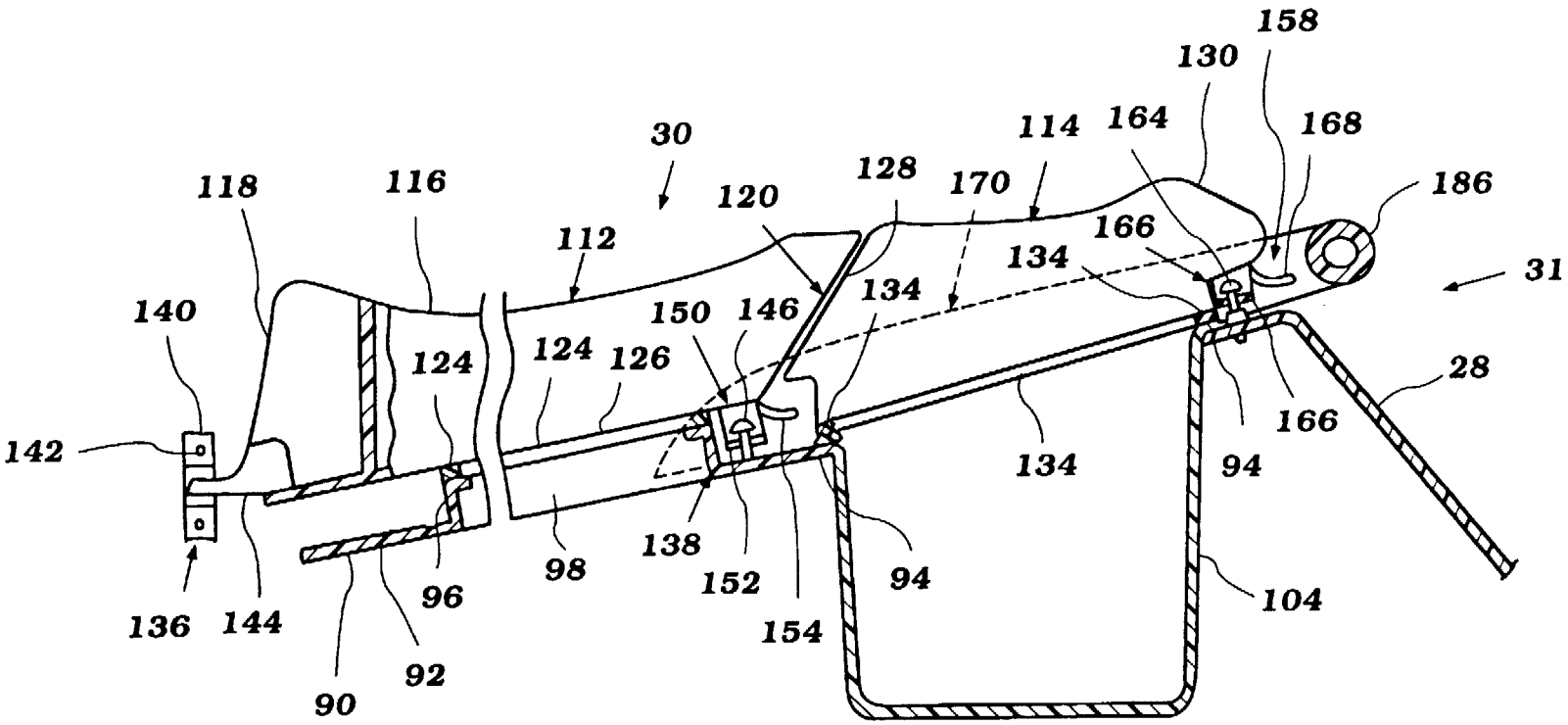
FIG. 3 is a partial sectional view of the seat of FIG. 1.
Figure 4:
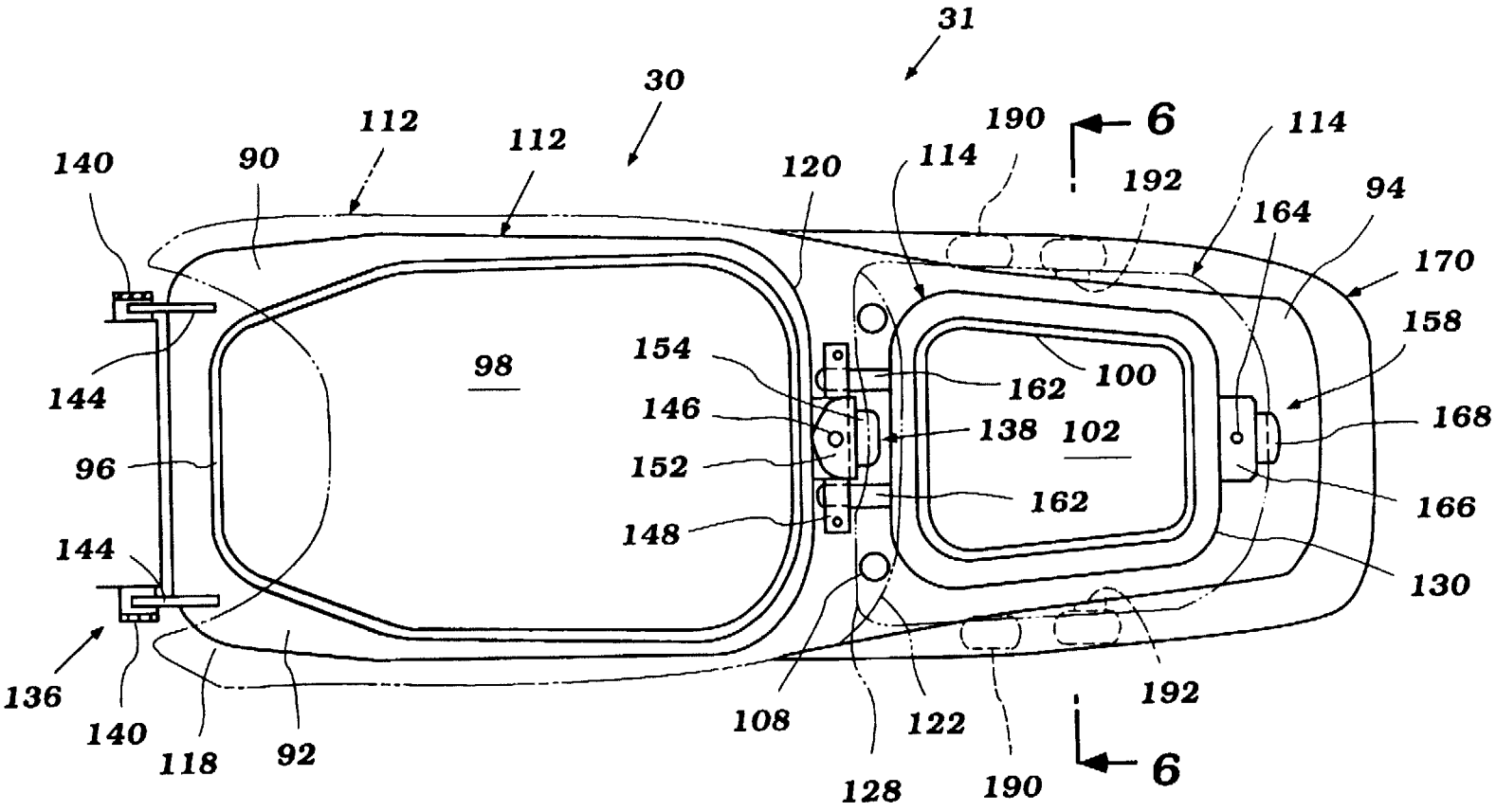
FIG. 4 is a top plan view of the seat of FIG. 1, with the seat cushion of the seat shown in phantom.
Figure 5:
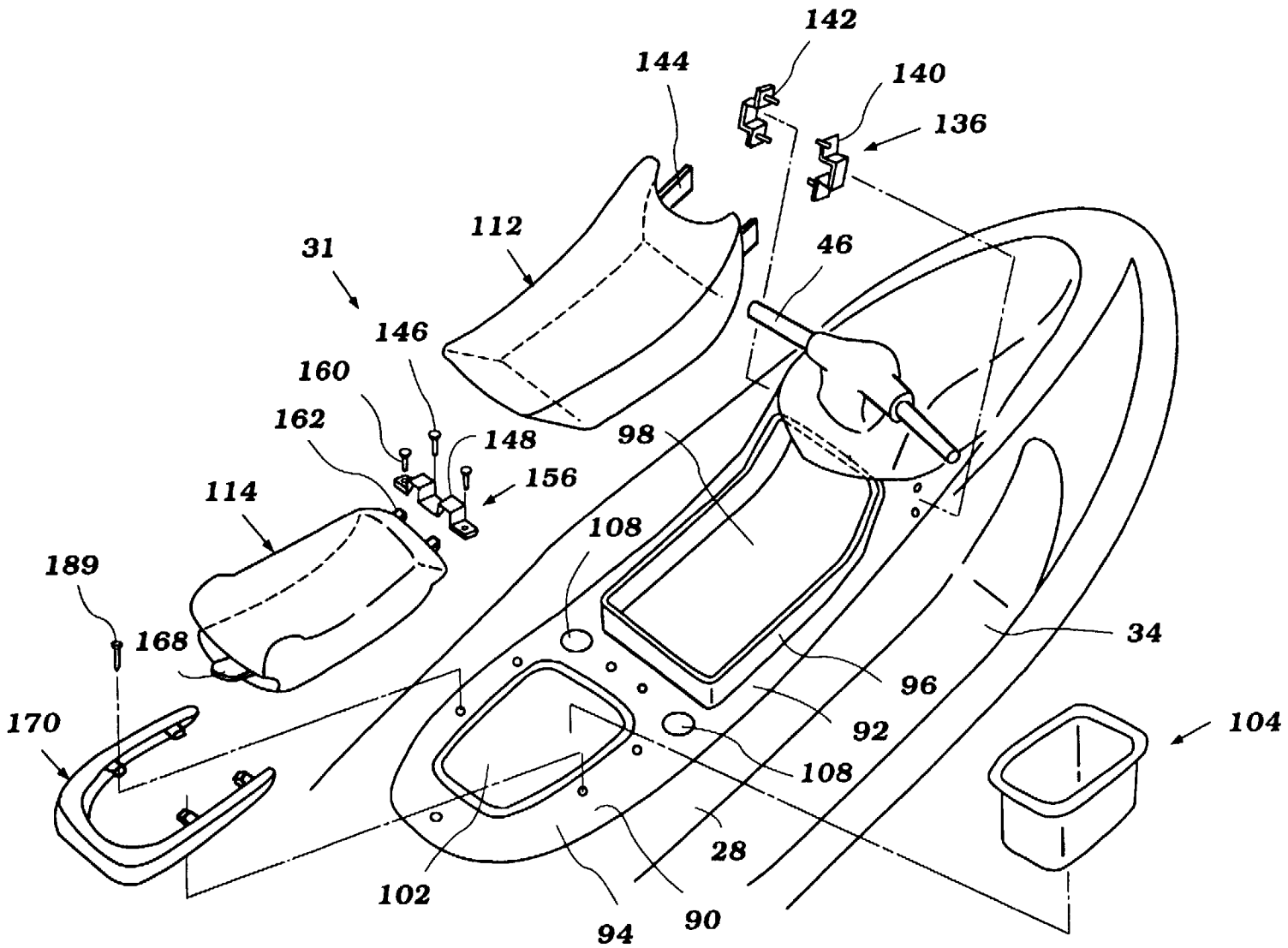
FIG. 5 is a partially exploded, rear perspective view of the seat of FIG. 1.

With reference to FIGS. 3–5, the seat 31 of the present invention will now be described in more detail. The raised pedestal 28 includes a generally horizontal upper surface 90. The upper surface 90 has a front portion 92 and a rear portion 94 located directly behind the front portion 92. A generally rectangular flange 96 extends from the front portion 92 of the upper surface 90 and defines the periphery of a corresponding generally rectangular access opening 98. The access opening 98 provides access to the engine compartment 52.

A second generally rectangular flange 100 extends from the rear portion 94 of the upper surface 90 and defines the periphery of a corresponding generally rectangular opening 102. A storage container 104 for storing various items rests within the opening 102. An upper part of the storage container 104 includes a flange 106. The flange 106 rests on the flange 100 (FIG. 6) of the upper surface 90 for supporting the container 104. A pair of vent holes 108 are provided in the upper surface 90 of the raised pedestal 28 between openings 98, 102. The vent holes 108 communicate with an air duct 109 (FIG. 8) located in the engine compartment 52. The air duct 109 includes an inlet branch 110 and a pair of outlet branches 111. The outlet branches 111 communicate with the vent holes 108.

The seating assembly 30 includes a removable front seat member 112 and a removable rear seat member 114 located directly behind the front seat member 112. The front seat member 112 has a height that is at least one-third the width of the seat member 112. The front seat member 112 has an arcuate shape and includes a slightly arcuate upper seating surface 116 and a pair of opposite arcuate side surfaces 117. The slightly arcuate upper surface 116 has a slightly larger radius of curvature than the arcuate side surfaces 117. A relatively large radius of curvature transition R (FIG. 8) is provided between the side surfaces 117 and upper seating surface 116. The upper surface 116 mates with each of the side surfaces 117 along a pair of longitudinal lines of discontinuity. The upper surface 116 has a width measured between the lines of discontinuity in a lateral direction across the pedestal. The side surfaces 117 each have a width measured in the lateral direction from an outer edge of the side surface 117 to a point directly below the line of discontinuity. The width of the upper surface 116 is not greater than five times the width of the side surfaces 117. The front seat member 112 further includes a front portion 118 and rear portion 120. The rear portion 120 includes a rearwardly and upwardly angled rear face 122. The front seat member 112 is located above the access opening 98 and is removable from the upper surface 90 of the raised pedestal 28 in order to gain access to the engine compartment 52. To prevent water from entering the engine compartment 52, a seal 124 is disposed between the flange 96 of the upper surface 90 and the periphery of a concave bottom portion 126 of the front seat member 112.

The aforementioned expansion chamber 74 extends partially through the access opening 98 and below at least a portion of the concave bottom portion 126 of the front seat member 112 so that the vertical distance between the foot areas 32 and the upper surface 90 of the front portion 92 of the raised pedestal 28 is less than the vertical distance between the foot areas 32 and an uppermost portion of the expansion chamber 74.

The upper surface 90 of the front portion 92 of the raised pedestal 28 in the present invention is located at a lower vertical height and more inwardly than the upper surface of the front portion of the raised pedestal A in prior seats (FIG. 8). This construction allows the front seat member 112 to have a greater radius of curvature transition R between the upper surface 116 and side surfaces 117. The greater radius of curvature transition gives the seat member 112 a more rounded seating contour that still provides adequate cushioning for the riders. The more rounded seating contour provides a more ergonomic and comfortable front seat 112 for the riders, especially when leaning or shifting to one side.

The rear seat member 114 is removable from the upper surface 90 of the rear portion 94 of the raised pedestal 28 for gaining access to the storage container 104 and gaining access to a latching assembly 138, which will be described in more detail below. The rear seat member 114 includes a front portion 128 and a rearward portion 130. The front portion 128 of the rear seat member 114 includes a forwardly and downwardly angled construction that provides a cooperative mating fit with the rear face 122 of the front seat member 112. The front face 132 extends from the front portion 128 and cooperates with the rear face 122 of the front seat member 112 to cover the latching assembly 138. To prevent water from entering the storage container 104, a seal 134 is provided between the flange 111 of the storage container 104 and the bottom portion 126 of the rear seat member 114.

The manner in which the front and rear seat members 112, 114 are secured to the raised pedestal 28 will now be described. The front seat member 112 is detachably secured to the upper surface 90 of the raised pedestal 28. To provide this detachable securement, a guiding assembly 136 and latching assembly 138 are provided for the front seat member 112. With reference to FIGS. 3–5, the guiding assembly 136 includes a pair of guide-receiving brackets 140 mounted to opposite sides of the raised pedestal 28 near the front of the pedestal 28. The guide-receiving brackets 140 are attached to the raised pedestal 28 by a corresponding pair of fasteners 142. A pair of guide extensions 144 extend from the front portion 118 of the front seat member 112. The guide extensions 144 mate with the receiving brackets 140 for attaching the front seat member 112 to the raised pedestal 28.

The latching assembly 138 is provided at the rear portion 120 of the front seat member 112. The latching assembly 138 includes a receiving pin or keeper 146 that is mounted, with a second guide-receiving bracket 148, to the upper surface 90 of the raised pedestal 28. A latching mechanism 150 is provided at the rear of the bottom portion 126 of the front seat member 112. The latching mechanism includes a shroud 152 affixed to the bottom portion 126 of the front seat member 112. A lever 154 is pivotally connected to the shroud 152 and operates a slidable retainer (not shown) which releasably engages the receiving pin 146 to lock the front seat member 112 in place. The front seat member 112 is removed from the upper surface 90 of the raised pedestal 28 by pulling the lever 154 upwardly so as to release the receiver from engagement with the pin 146 and, thus, unlock the latching mechanism 150.

The rear seat member 114 is detachably secured to the rear portion 94 of the upper surface 90 of the raised pedestal 28 in a similar manner to that described above for the front seat member 112. To detachably secure the rear seat member 114 to the raised pedestal 28, a guiding assembly 156 and latching assembly 158 are provided. The guiding assembly 156 includes a guide-receiving bracket 148. The bracket 148 is mounted to the upper surface 90 of the surface 90 of the raised pedestal 28 by a pair of fasteners 160. A pair of guide extensions 162 extend from the front portion 128 of the rear seat member 114. The guide extensions 162 mate with the aforementioned guide-receiving bracket 148 for attaching the rear seat member 114 to the raised pedestal 28. The latching assembly 148 is provided at the rear of the bottom portion 146 of the rear seat member 114. The latching assembly 158 is similar to latching assembly 138 and includes a receiving pin 164 that is mounted to the upper surface 90. A latching mechanism 166 is provided at a rear part of the bottom 126 of the rear seat member 114. The latching mechanism includes a shroud 166 and a pivotally-connected lever 168 that operates a slidable retainer (not shown) for releasably engaging the receiving pin 164 in the same manner as that described above.

To gain access to the engine compartment 52 for maintenance or other purposes, the front seat member 112 is removed from the upper surface 90 of the raised pedestal 28. In order to do this, the rear seat member 114 must first be removed because the front portion 128 of the rear seat member 114 cooperates with the rear portion 120 of the front seat member 112 and latching assembly 138 so that the front seat member 112 cannot be removed before removing the rear seat member 114. The rear seat member 114 is removed by operating the latching assembly 158 and removing the guide extensions 162 of rear seat member 114 from the guide receiving bracket 148. Removing the rear seat member 114 allows access to the latching assembly 138 of the front seat member 112. The latching assembly 138 is operated and the front seat member 112 is removed from the upper surface 90 of the raised pedestal 28.

The seating assembly 30 of the present invention requires the rear seat 114 to be removed before the front seat 112 can be removed. This construction helps to prevent any part of the seating assembly 30, especially the rear seat member 114, from becoming dirty or damaged from a mechanic or anyone else accidentally leaving a part of the seating assembly 30 on the raised pedestal 28 when gaining access to the engine compartment 52.

Figure 6:
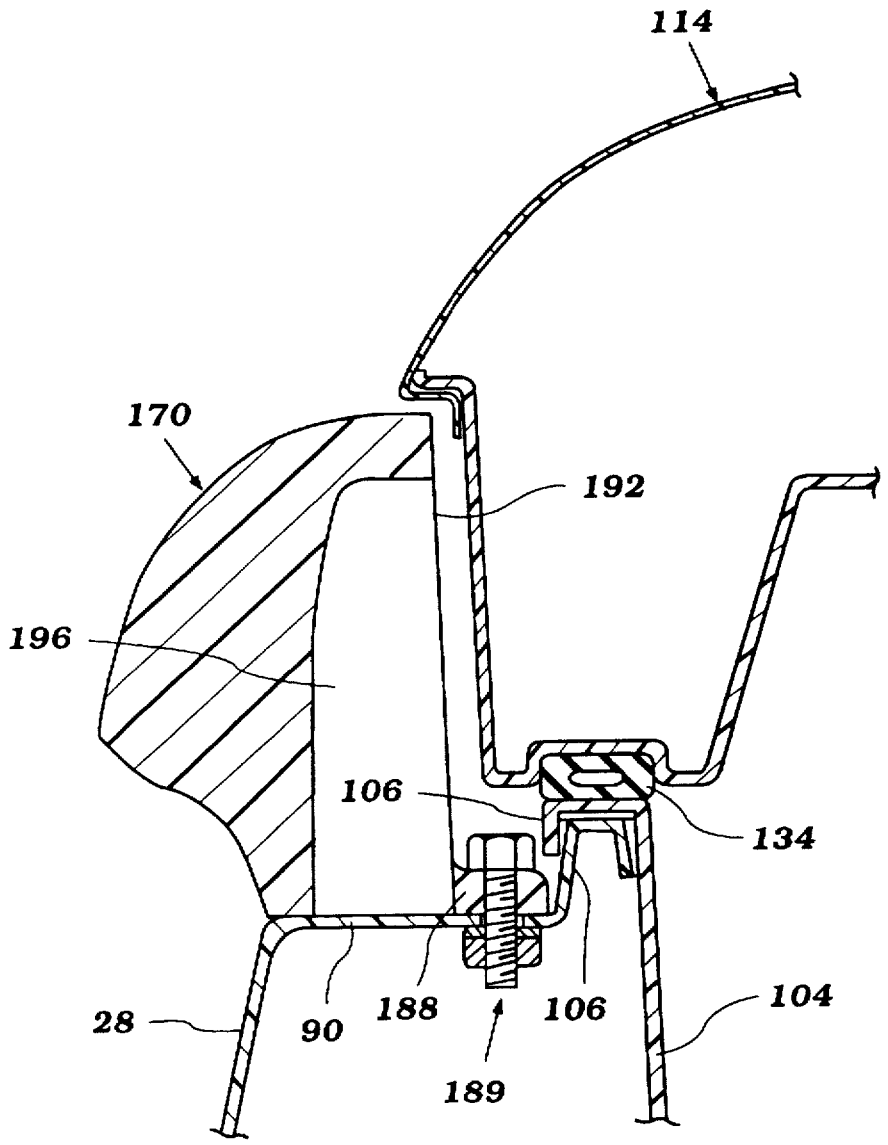
FIG. 6 is a partial cross-sectional view taken along line 6—6 of FIG. 4 of the seat of FIG. 1.
Figure 7:
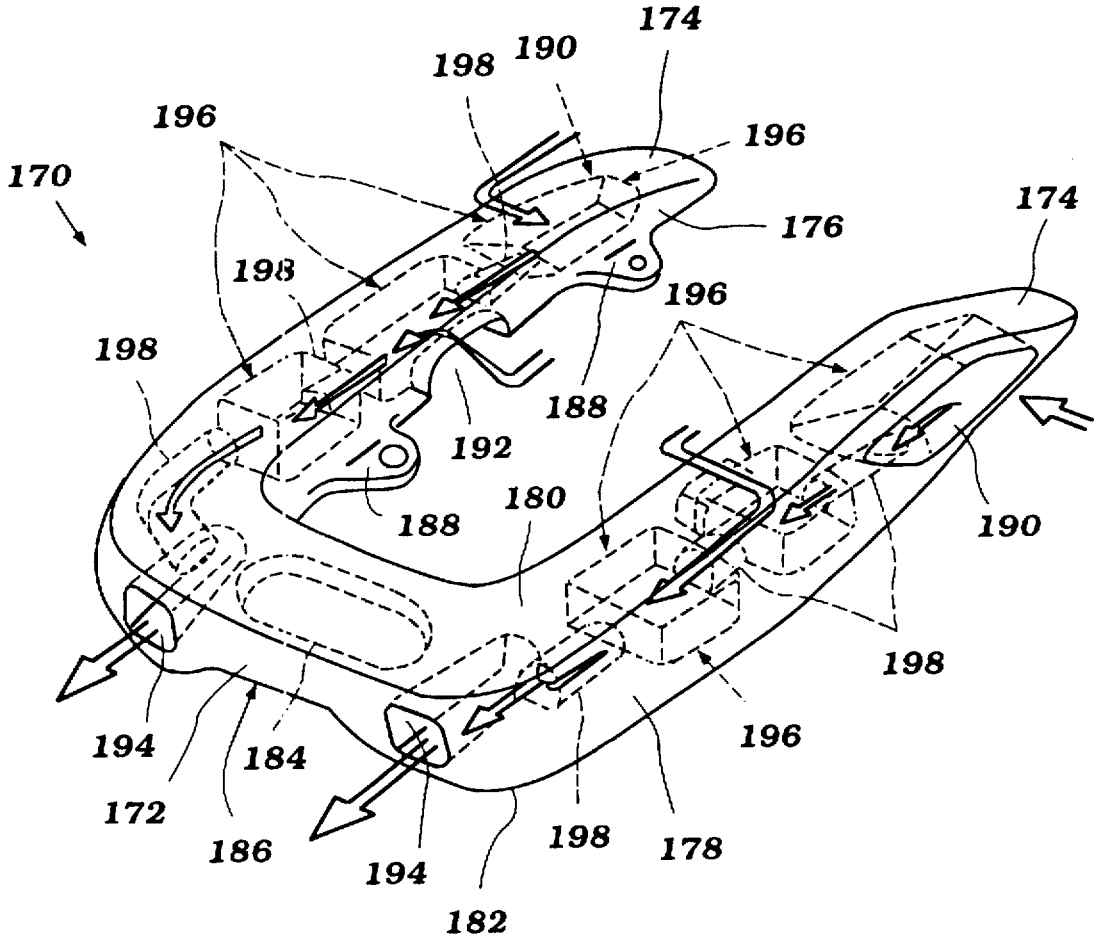
FIG. 7 is a rear perspective view of an insert piece of the seat, with a portion of the insert piece shown in phantom.

With reference to FIGS. 5–7, an insert piece, indicated generally by the reference numeral 170, is provided near the periphery of the rear portion 94 of the upper surface 90 of the raised pedestal 28. Part of the insert piece 170 is interposed between part of the rear seat member 114 and part of the rear portion 120 of the front seat member 112 and the upper surface 90 of the raised pedestal 28. The insert piece 170 includes a grip 172 and a pair of generally parallel arms 174 that extend from the grip 172. Together, the grip 172 and arms 174 give the insert piece 170 a generally U-shaped structure. The inset piece 170 includes a generally vertical inner wall 176, a generally vertical outer wall 178, a generally horizontal upper surface 180 and a generally horizontal lower surface 182. An aperture 184 preferably extends partially through a bottom portion of the grip 172 so as to form a hand grip 186 in the underside of the grip 172 for assisting a rider in boarding the watercraft from the rear. A plurality of mounting flanges 188 extend from the inner wall 176 of the insert piece 170 for mounting the insert piece 170 to the upper surface 90 of the raised pedestal 28. A plurality of fasteners 189 are provided for mounting the insert piece 170 to the upper surface 90.

The insert piece 170 includes a venting mechanism in each of the arms 174 that draws air from the engine compartment 52. The venting mechanism includes an atmospheric air inlet port 190 provided in a front portion of the outer wall 178 of each of each of the arms 174 of the insert piece 170. The configuration of the air inlet port 190 allows it to draw atmospheric air into the insert piece 170 during watercraft travel. An engine air inlet port 192 is provided near the center of the inner wall 176 of each of the arms 174 of the insert piece 170. A pair of air outlet ports 194 are provided in the outer wall 178 of the grip portion 172. A plurality of air chambers 196 and corresponding conduits 198 are provided in each of the arms 174 and communicate with the aforementioned ports 190-194. Together, the air chambers 196, conduits 198, atmospheric air inlet port 190 and air outlet port 194 form an air passage.

During operation of the watercraft, atmospheric air is drawn into the atmospheric air inlet ports 190, flows through the air passages and is expelled out of the air outlet ports 194. The configuration of the air chambers 196 and conduits 198 cause air from the engine compartment 52 to be drawn into the venting mechanism when atmospheric air flows through each of the passages. Air flows from the engine compartment 52, through the air duct 109, into the engine compartment air inlet port 192, into the air passage and out of the air outlet port 194. This arrangement assists the air inlets 40 and 48 in ventilating the engine compartment 52 and supplying air for operation of the engine 54.

It should be readily apparent from the foregoing description of the preferred embodiment of the invention how the seat of the present invention requires the removal of both seat members to gain access to the engine compartment, draws air from the engine compartment and provides a more ergonomic seat for the riders. Of course, the foregoing description is that of a preferred embodiment of the invention, and various changes and modifications may be made without departing from the spirit and scope of the invention, as defined by the appended claims.

What is claimed is:

1. A small watercraft comprising a hull including a deck portion having a longitudinally extending raised pedestal, said raised pedestal having an upper surface which includes a front portion and a rear portion, an engine compartment formed at least in part beneath the front portion of the raised pedestal, an engine contained within said engine compartment that drives a propulsion unit for powering said watercraft, an access opening provided in the front portion of the upper surface of the raised pedestal for allowing access to the engine compartment, a removable front seat member supported by the front portion of the upper surface of the raised pedestal which covers the access opening, said front seat member having front and rear ends, a latching assembly provided adjacent the rear end of the front seat member which detachably secures at least the rear end of the front seat member to the front portion of the upper surface of the raised pedestal, a removable rear seat member supported by the rear portion of the upper surface of the raised pedestal directly behind the front seat member, the rear seat member having front and rear ends, the front end of the rear seat member covering said latching assembly associated with the front seat member so that the latching assembly is not accessible without removing said rear seat member.

2. The small watercraft of claim 1, wherein the latching assembly includes a receiving pin and a latching mechanism which is releasably engageable with the receiving pin.

3. The small watercraft of claim 2, further including a securing assembly that is provided adjacent to the front end of the front seat member, the securing assembly includes at least one guide bracket and at least one corresponding guide extension that cooperates with said guide bracket so as to secure the front end of the front seat member to the raised pedestal.

4. The small watercraft of claim 3, further including a second latching assembly that is provided adjacent to the rear end of the rear seat member which detachably secures at least the rear end of the rear seat member to the rear portion of the upper surface of the raised pedestal, the latching assembly includes a receiving pin and a latching mechanism which is releasably engageable with the receiving pin.

5. The small watercraft of claim 4, further including a securing assembly that is provided adjacent to the front end of the rear seat member, the securing assembly includes a guide bracket and at least one guide extension that cooperates with said guide bracket so as to secure the front end of the rear seat member to the raised pedestal.

6. The small watercraft of claim 1, further including an insert piece provided near the periphery of the rear portion of the upper surface of the raised pedestal, the insert piece includes means for venting air from the engine compartment.

7. The small watercraft of claim 1, further including an insert piece provided near the periphery of the rear portion of the upper surface of the raised pedestal, the insert piece having at least one arm that includes a venting mechanism communicating with the engine compartment.

8. The small watercraft of claim 7, wherein the venting mechanism includes an atmospheric air inlet port and an air outlet port, a passage is provided between the atmospheric air inlet port and air outlet port which allows air to flow from the atmospheric air inlet port to the air outlet port, the passage includes at least one chamber and corresponding conduit configured to draw air from the engine compartment when atmospheric air flows therethrough.

9. The small watercraft of claim 1, further including an exhaust system that communicates with the engine and discharges exhaust gases from the watercraft, a portion of the exhaust system extends at least partially through the access opening and below at least a portion of the front seat member.

10. The small watercraft of claim 1, further including an exhaust system that communicates with the engine and discharges exhaust gases from the watercraft, a pair of foot areas are provided at opposite sides of the raised pedestal which support the feet of at least one rider, the vertical distance between the foot areas and the upper surface of the front portion of the raised pedestal is less than the vertical distance between the foot areas and an uppermost portion of the exhaust system.

11. A small watercraft comprising a hull including a deck portion having a longitudinally extending raised pedestal with an upper surface, an engine compartment formed at least in part beneath the raised pedestal, an engine contained within said engine compartment which drives a propulsion unit that powers said watercraft, an access opening provided in the upper surface of the raised pedestal for allowing access to the engine compartment, a first removable seat member supported by the upper surface of the raised pedestal in a position covering the access opening, a removable second seat member supported by the upper surface of the raised pedestal, an attachment assembly provided for detachably securing the first and second seat member with the raised pedestal, that attachment assembly including an attachment mechanism that cooperates with the second seat member to prevent detachment of the first seat member without prior detachment of the second seat member.

12. The small watercraft of claim 11, wherein the first and second seat members include front and rear ends, the attachment mechanism includes a latching assembly that is provided adjacent to the rear end of the first seat member which detachably secures at least the rear end of the first seat member to the upper surface of the raised pedestal, the front end of the second seat member cooperates with the rear end of the first seat member to cover the latching assembly associated with the front seat member so that the latching assembly is not accessible without the prior removal of the second seat member.

13. The small watercraft of claim 11, further including an insert piece provided near the periphery of a rear portion of the upper surface of the raised pedestal, the insert piece includes a venting mechanism that vents air from the engine compartment.

14. The small watercraft of claim 13, wherein the venting mechanism includes an atmospheric air inlet port and an air outlet port, a passage is provided between the atmospheric air inlet port and air outlet port which allows air to flow from the atmospheric air inlet port to the air outlet port, the passage includes at least one chamber and corresponding conduit configured to draw air from the engine compartment when atmospheric air flows therethrough.

15. The small watercraft of claim 11, further including an exhaust system that communicates with the engine and discharges exhaust gases from the watercraft, a portion of the exhaust system extends at least partially through the access opening and below at least a portion of the first seat member.

16. The small watercraft of claim 11, further including an exhaust system that communicates with the engine and discharges exhaust gases from the watercraft, a pair of foot areas are provided at opposite sides of the raised pedestal which support the feet of at least one rider, the vertical distance between the foot areas and the upper surface of the front portion of the raised pedestal is less than the vertical distance between the foot areas and an uppermost portion of the exhaust system.

17. A small watercraft comprising a hull including a deck portion having a longitudinally extending raised pedestal with an upper surface, an engine compartment formed at least in part beneath the raised pedestal, an engine contained within said engine compartment which drives a propulsion unit for powering said watercraft, a seating assembly including at least one seat member supported by the upper surface of the raised pedestal, an insert piece provided near the periphery of the upper surface of the raised pedestal, the insert piece including a venting mechanism that vents air from the engine compartment, a grip, and a pair of generally parallel arms that extend from said grip so as to give the insert piece a generally U-shaped structure.

18. The small watercraft of claim 17, wherein the venting mechanism includes an atmospheric air inlet port and an air outlet port, a passage is provided between the atmospheric air inlet port and air outlet port which allows air to flow from the atmospheric air inlet port to the air outlet port, the passage includes at least one chamber and corresponding conduit configured to draw air from the engine compartment when atmospheric air flows therethrough.

19. The small watercraft of claim 18, wherein the insert piece includes inner and outer walls and upper and lower surfaces, the atmospheric air inlet is provided in the outer wall of at least one of the arms, the engine compartment air inlet is provided in the inner wall of at least one of the arms and the air outlet is provided in the outer wall of the grip.

20. The small watercraft of claim 19, wherein at least one aperture is provided in a rear portion of the upper surface of the raised pedestal which allows the engine compartment to communicate with the engine compartment air inlet port of the insert piece.

21. The watercraft of claim 17, wherein the grip includes an aperture that extends at least partially through the grip so as to provide a hand grip.

22. The small watercraft of claim 17, further including an access opening provided in the upper surface of the raised pedestal for allowing access to the engine compartment, an exhaust system communicates with the engine and discharges exhaust gases from the watercraft, a portion of the exhaust system extends at least partially through the access opening and below at least a portion of said at least one seat member.

23. The small watercraft of claim 17, further including an exhaust system that communicates with the engine and discharges exhaust gases from the watercraft, a pair of foot areas are provided at opposite sides of the raised pedestal for supporting the feet of at least one rider, the vertical distance between the foot areas and a portion of the upper surface of the raised pedestal is less than the vertical distance between the foot areas and an uppermost portion of the exhaust system.

24. The small watercraft of claim 17, wherein said seating assembly includes a front seat member having a front end and a rear end, a latching assembly is provided adjacent to the rear end of the front seat member which detachably secures at least the rear end of the front seat member to the upper surface of the raised pedestal, a removable rear seat member is supported by the upper surface of the raised pedestal directly behind the front seat member, the rear seat member includes a front and rear end, the front end of the rear seat member covers the latching assembly associated with the front seat member so that the latching assembly is not accessible without removing the rear seat member.

25. A small watercraft comprising a hull including a deck portion having a longitudinally extending raised pedestal with an upper surface, an engine compartment formed at least in part beneath the raised pedestal, an engine contained within said engine compartment that drives a propulsion unit for powering said watercraft, an exhaust system communicating with the engine and discharging exhaust gases from the watercraft, the exhaust system including an expansion chamber, an access opening provided in the upper surface of the raised pedestal for allowing access to the engine compartment, a seating assembly including at least one removable seat member supported by the upper surface of the raised pedestal, a portion of the expansion chamber extending at least partially through the access opening and below at least a portion of said at least one seat member.

26. The small watercraft of claim 25, wherein seating assembly includes first and second removable seat members, the first seat member includes an upper surface and a pair of side surfaces, the upper surface mating with each of the side surfaces along a longitudinal line of discontinuity, said upper surface having a width measured between the lines of discontinuity in a direction laterally across the pedestal, said side surfaces each having a width measured in the lateral direction from an outer edge of the side surface to a point directly below the line of discontinuity, the width of the upper surface not being greater than five times the width of the side surfaces.

27. The small watercraft of claim 26, wherein the first seat member has a height which is at least one-third the width of the seat.

28. The small watercraft of claim 27, wherein the upper surface of the first seat member has an arcuate shape, the side surfaces also have an arcuate shape.

29. The small watercraft of claim 28, wherein a first curved transition section joins together the upper surface and one side surface and a second curved transition section joins together the upper surface and the other side surface, and the upper surface has a larger radius of curvature than either of the transition sections.

30. The small watercraft of claim 25, further including an insert piece provided near the periphery of a rear portion of the upper surface of the raised pedestal, the insert piece includes a venting mechanism that vents air from the engine compartment.

31. The small watercraft of claim 25, wherein the venting mechanism includes an atmospheric air inlet port and an air outlet port, a passage is provided between the atmospheric air inlet port and air outlet port which allows air to flow from the atmospheric air inlet port to the air outlet port, the passage includes at least one chamber and corresponding conduit configured to draw air from the engine compartment when atmospheric air flows therethrough.

32. The small watercraft of claim 25, wherein said seating assembly includes a front seat member having a front end and a rear end, a latching assembly is provided adjacent to the rear end of the front seat member which detachably secures at least the rear end of the front seat member to the upper surface of the raised pedestal, a removable rear seat member is supported by the upper surface of the raised pedestal directly behind the front seat member, the rear seat member includes a front and rear end, the front end of the rear seat member covers the latching assembly associated with the front seat member so that the latching assembly is not accessible without removing the rear seat member.

* * * * *

UNITED STATES PATENT AND TRADEMARK OFFICE

CERTIFICATE OF CORRECTION

PATENT NO. : 5,752,867
DATED : May 19, 1998
INVENTOR(S) : Tomoyoshi Koyanagi

It is certified that error appears in the above-identified patent and that said Letters Patent is hereby corrected as shown below:

Column 7,
Line 1, please delete "of the surface 90"

Claim 6,
Line 2, please change "the periphery" to -- a periphery --

Claim 7,
Line 2, please change "the periphery" to -- a periphery --

Claim 10,
Line 5, please change "the feet" to -- feet --; and "the vertical" to -- a vertical --
Line 7, please change "the vertical" to -- a vertical --

Claim 13,
Line 2, please change "the" to -- a --

Claim 16,
Line 5, please change "the feet" to -- feet --; and "the vertical" to -- a vertical --
Line 6, please change "of the" to -- of a --
Line 7, please change "the vertical" to -- a vertical --

Claim 17,
Line 8, please change "near the" to -- near a --

Claim 19,
Line 4, please change "the engine" to -- an engine --

Claim 23,
Line 5, please change "the feet" to -- feet --; and "the vertical" to -- a vertical --
Line 7, please change "the vertical" to -- a vertical

UNITED STATES PATENT AND TRADEMARK OFFICE

CERTIFICATE OF CORRECTION

PATENT NO. : 5,752,867
DATED : May 19, 1998
INVENTOR(S) : Tomoyoshi Koyanagi

It is certified that error appears in the above-identified patent and that said Letters Patent is hereby corrected as shown below:

Claim 26,
Line 1, please change "wherein" to -- wherein the --

Claim 30,
Line 2, please change "the" to -- a --

Claim 31,
Line 1, please change "wherein the" to -- wherein a --

Signed and Sealed this

Twenty-ninth Day of January, 2002

*Attest:*

*Attesting Officer*

JAMES E. ROGAN
*Director of the United States Patent and Trademark Office*